US005145733A

United States Patent [19]

Kadokura

[11] Patent Number: 5,145,733

[45] Date of Patent: Sep. 8, 1992

[54] ELECTRO-DEPOSITION COATED MEMBER

[75] Inventor: Susumu Kadokura, Sagamihara, Japan

[73] Assignee: Canon Kabushiki Kaisha, Tokyo, Japan

[21] Appl. No.: 670,274

[22] Filed: Mar. 15, 1991

[30] Foreign Application Priority Data

| | | | |
|---|---|---|---|
| Mar. 16, 1990 | [JP] | Japan | 2-064025 |
| Mar. 19, 1990 | [JP] | Japan | 2-066871 |
| Mar. 20, 1990 | [JP] | Japan | 2-068361 |
| Mar. 20, 1990 | [JP] | Japan | 2-068362 |
| Mar. 22, 1990 | [JP] | Japan | 2-075149 |
| Mar. 24, 1990 | [JP] | Japan | 2-074205 |

[51] Int. Cl.[5] ..... G22F 3/00

[52] U.S. Cl. ..... 428/551; 428/553; 428/618; 428/628; 428/629; 428/457; 428/469

[58] Field of Search ..... 428/551, 553, 618, 628, 428/629, 457, 469

[56] References Cited

U.S. PATENT DOCUMENTS

| | | | |
|---|---|---|---|
| 4,382,981 | 5/1983 | Stoetzer et al. | 427/105 |
| 4,579,882 | 4/1986 | Kanbe et al. | 523/137 |
| 4,631,214 | 12/1986 | Hasegawa | 428/251 |
| 4,647,714 | 3/1987 | Goto | 428/681 |
| 4,806,200 | 2/1989 | Larson et al. | 156/652 |
| 4,844,784 | 7/1989 | Suzuki et al. | 204/180.9 |
| 4,863,789 | 9/1989 | Arai | 428/253 |

FOREIGN PATENT DOCUMENTS 1401301 4/1964 France .

OTHER PUBLICATIONS

Patent Abstracts of Japan, vol. 10, No. 390, Dec. 26, 1986 & JP-A-61 177 399.

*Primary Examiner*—Stephen J. Lechert, Jr.
*Attorney, Agent, or Firm*—Fitzpatrick, Cella, Harper & Scinto

[57] ABSTRACT

An electro-deposition coated member has a metal substrate or a non-metal substrate having been subjected to metal plating, a chemically colored film provided on said substrate, and a conductive electro-deposition coating film formed on said chemically colored film.

22 Claims, 6 Drawing Sheets

ELECTRO-DEPOSITION COATED MEMBER

BACKGROUND OF THE INVENTION

1. Field of the Invention

The present invention relates to an electro-deposition coated member capable of improving electromagnetic wave shielding effect, that can be used as a housing for electronic machinery including optical instruments such as cameras, sound instruments such as CD players, and office automation machinery, which are sources from which electromagnetic waves are generated. It also relates to a process for producing such an electro-deposition coated member, and an electro-deposition coating composition used therefor.

2. Related Background Art

In recent years, as electronic circuits have been made more small-sized, complicated and precise, the misoperations and noise caused by electromagnetic waves generated from other component parts and circuits have presented major problems. The electronic circuits themselves also generate electromagnetic waves, and also offer an important problem on their influences on surroundings. In order to prevent these problems, it is sought to shield electronic circuits from invasion or radiation of electromagnetic waves.

As methods for shielding electromagnetic waves, a method is conventionally known in which a circuit substrate is surrounded with a metallic housing comprising a conductive material. However, as the products are recently made small-sized and light-weight, it has been prevailing to use a housing comprised of a plastic material. As a method of making such a plastic housing conductive, it has been prevailing to use spray coating using a conductive coating composition. Other methods are also used which include zinc spray coating, electroless plating, vacuum deposition and conductive plastic coating.

The conventional methods, however, have the following disadvantages.

The conductive coating composition for spraying can achieve no sufficient electromagnetic wave shielding effect unless a conductive filler is contained in an amount of not less than 60 parts by weight and moreover a coating thickness is not less than 30 μm in the case of a copper filler and not less than 50 μm in the case of a nickel filler. For this reason, this coating composition is not suitable for decorative coating that provides an exterior coat on a housing.

In instances in which metal powder is used as the fillers, the metal powder has so large a specific gravity that it is required for the powder to be again dispersed when coating compositions are used, which, however, is not easy. To solve this problem, Japanese Patent Application Laid-open No. 59-223763 discloses a conductive coating composition for electromagnetic wave shielding in which Ni-coated mica powder is used as a conductive filler. This coating composition also can not achieve a sufficient electromagnetic wave shielding effect unless a coating is formed in a large thickness of 50 μm or more.

In addition, in housing with complicated shapes, the coating thickness tends to be non-uniform, often resulting in an insufficient shielding effect.

As for the zinc spray coating, it must give a coating thickness of as large as from 50 to 100 μm in order to ensure the shielding effect, and also has a difficulty in adhesion to substrates. For this reason, it becomes necessary to provide steps for blast finishing, etc. In addition, there is still a problem in mass productivity because of a work environment worsened by zinc vapor gas.

In regard to the electroless plating, an electromagnetic wave shilding effect can be obtained when, for example, a copper coating is formed in a thickness of 1.0 μm to 1.5 μm or more. Since, however, the whole housing is plated, it becomes indispensable when used as a housing of a product, to form a coating film on the plated surface to improve the nice-looking appearance so that the commercial value can be enhanced. In doing so, however, there is a problem of the poor adhesion between the film surface formed by plating and the coating surface formed by coating. In particular, mere plating with copper may cause changes with time to bring about corrosion, resulting in a lowering of performances. Hence, the copper-plated surface must be subjected to nickel plating so that the quality can be prevented from being lowered. Moreover, since this nickel plating may greatly impair the adhesion to the coating film, the coating must be carried out using very limited materials such as special coating compositions as exemplified by Origiplate Z (available from Origin Electric Co., Ltd.). This greatly effect cost and can not be mass-productive.

On the other hand, a conductive plastic housing is known, which is formed of a mixture of a resin and a conductive filler such as metal powder with particle diameters of several tens or more μm or metal fiber. The resulting plastic housing, however, has too seriously uneven a surface to be usable as an exterior member if it is used in the state of a molded product untreated or unfinished. Thus, there is the problem that decorative coating must be applied in order to attain commercial value. In addition, because of poor conductivity, any secondary finishing becomes necessary for achieving perfect electromagnetic wave shielding, which can not be mass-productive. Moreover, since conductive plastic materials themselves are expensive, there is also a limit on its practical utilization.

SUMMARY OF THE INVENTION

The present invention was made taking account of the above disadvantages. An object of the present invention is to provide an electro-deposition coated member that can achieve a high shielding effect even with a small coating thickness, has improved in adhesion, uniformity and druability of coating films, and also can promise superior corrosion resistance.

Another object of the present invention is to provide a process for producing an electro-deposition coated member, capable of forming on a substrate an electro-deposition coating film that has good electromagnetic wave shielding effect and is more improved in adhesion to substrates and uniformity without adversely affecting the substrate, and also can be applied to decorative coating of housings.

Still another object of the present invention is to provide an electro-deposition coating composition used to form an electro-deposition coated member having superior shielding properties and superior coating properties.

The electro-deposition coated member of the present invention comprises a metal substrate or a non-metal substrate having been subjected to metal plating, a chemically colored film provided on said substrate, and a conductive electro-deposition coating film formed on said chemically colored film.

The process of the present invention for producing an electro-deposition coated member comprises the steps of;

forming a chemically colored film on a metal substrate or a non-metal substrate having been subjected to metal plating on its surface;

thereafter subjecting the substrate to electro-deposition in an electro-deposition coating composition comprising a resin feasible for electro-deposition and conductive particles, to deposit together said resin and conductive particles on said chemically colored film to form an electro-deposition coating; and subsequently curing said electro-deposition coating at a low-temperature to form an electro-deposition coating film.

The electro-deposition coated member of the present invention may also comprise a metal substrate or a non-metal substrate having been subjected to metal plating, and an electro-deposition coating film provided thereon, said electro-deposition coating film containing at least one of i) a resin powder having an average particle diameter of from 0.1 to 5 μm whose particle surfaces are coated with a metal and ii) an ultrafine metal powder having an average particle diameter of from 0.01 to 5 μm.

The electro-deposition coating composition of the present invention may also comprise a resin feasible for electro-deposition, and at least one of i) a resin powder having an average particle diameter of from 0.1 to 5 μm whose particle surfaces are coated with a metal and ii) an ultrafine metal powder having an average particle diameter of from 0.01 to 5 μm.

The electro-deposition coating composition of the present invention may also comprise a resin feasible for electro-deposition, a ceramic powder having an average particle diameter of from 0.1 to 5 μm whose particle surfaces are coated with a metal, and at least one of i) an ultrafine metal powder having an average particle diameter of from 0.01 to 5 μm and ii) a resin powder having an average particle diameter of from 0.01 to 5 μm whose particle surfaces are coated with a metal.

The electro-deposition coating composition of the present invention may further contain as conductive particles a natural mica powder whose particle surfaces are coated with a metal.

The electro-deposition coating composition of the present invention may also comprise a resin feasible for electro-deposition, a natural mica powder whose particle surfaces are coated with a metal, and at least one of i) a ceramic powder whose particle surfaces are coated with a metal, ii) a resin powder having an average particle diameter of from 0.1 to 5 μm whose particle surfaces are coated with a metal and iii) an ultrafine metal powder having an average particle diameter of from 0.01 to 5 μm.

The present invention also provides electronic machinery comprising a housing and an electronic part enclosed in said housing, the latter being a source from which an electromagnetic wave noise is generated, wherein said housing comprises a metal substrate or a non-metal substrate having been subjected to metal plating, a chemically colored film provided on said substrate, and a conductive electro-deposition coating film formed on said chemically colored film.

DESCRIPTION OF THE PREFERRED EMBODIMENTS

The present invention will be described below in detail.

The electro-deposition coated member of the present invention is obtained by forming a chemically colored film on a metal substrate or an non-metal substrate having been subjected to metal plating, and then forming thereon a conductive electro-deposition coating film (hereinafter often "ED film"). The adhesion of the electro-deposition coating film to the substrate can thereby be greatly improved and it becomes possible to apply an electro-deposition coating film having electromagnetic wave shielding properties, to the exterior coating of housing for electronic machinery or the like.

Figure 1:
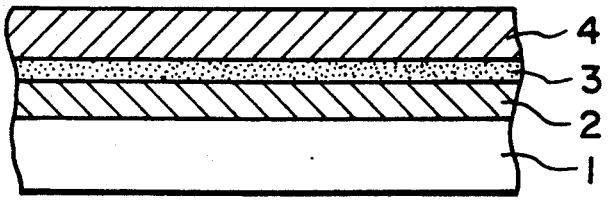
FIG. 1. is a schematic partial cross-section to shown an embodiment of the electro-deposition coated member of the present invention.

FIG. 1 is a schematic partial cross-section of the electro-deposition coated member of the present invention. In FIG. 1, the numeral 1 denotes a resin substrate; 2, a metal thin film formed on the resin substrate; 3, a chemically colored film; and 4, a conductive electro-deposition coating film, containing conductive particles.

In the present invention, the chemically colored film 3 can be formed by surface treatment of the metal thin film 2 formed on the substrate. The chemically colored film is preferable because it can improve the adhesion to the electro-deposition coating film to be formed thereon. Although it is unclear why this chemically colored film gives a good adhesion to the electro-deposition coating film, it can be pressumed that the surface of the chemically colored film has a large number of very fine pores and hence a physical adsorption can be produced at the interface with the ED film and also a chemical adsorption is produced between functional groups of a polymer in the ED film, active points on the surfaces of the conductive particles, and the chemically colored film, thus giving a greatly superior adhesion.

In the present invention, chemically colored film formed by surface treatment of a copper thin film, for example, a film comprised of cupric oxide, cuprous oxide, copper carbonate, copper sulfide or ammonium copper hydroxide can give an excellent adhesion to the ED film. In particular, the cupric oxide can be preferably used in view of the adhesion of the ED film to the substrate, the corrosion resistance of the metal thin film 2 and the uniformity of the ED film. Thus, it is preferred in the present invention to use a copper thin film as the metal thin film 2. When a material other than copper is used as the metal substrate, it is preferred to apply copper plating to its surroundings.

Here, the metal thin film 2 is provided to form an electrode for the formation of the ED film and to form the chemically colored film on its surface. It may preferably have a film thickness of from 0.05 μm to 0.2 μm, and particularly from 0.1 μm to 0.15 μm. A film thickness larger than 0.2 μm is not preferred since it becomes necessary to take a long time for the formation of the copper thin film, resulting in an increase in the weight of the electro-deposition coated member and also a lowering of work efficiency.

The film comprised of cupric oxide can be formed, for example, by immersing a copper-plated substrate in a solution comprising a mixture of copper sulfide and potassium chlorate or a solution comprising a mixture of copper chloride, copper acetate and alum.

The film comprised of copper sulfide can be formed, for example, by immersing the substrate in a solution comprising a mixture of potassium sulfide and ammonium chloride, or by immersing the substrate in a solution comprising a mixture of sodium hyposulfite and lead acetate.

The film comprised of copper hydroxide can be formed, for example, by immersing the substrate in a solution comprising a mixture of copper nitriate, ammonium chloride and acetic acid.

The film comprised of cuprous oxide can be formed, for example, by immersing the substrate in a solution comprising a mixture of copper sulfate and sodium chloride or a solution comprising a mixture of copper sulfate and ammonium chloride.

The conductive ED film 4 is comprised of conductive particles deposited together with a resin feasible for electro-deposition, in a high density on the chemically colored film, has a conductivity even though it is a thin film, and functions as a coating film for electromagnetic wave shielding.

In the present invention, there are no particular limitations on the conductive particles to be deposited together with the resin to form the electro-deposition coating, so long as they can impart conductivity to the electro-deposition coating. They include, for example, a ceramic powder whose particles surfaces are coated with metal (i.e., a metallized ceramic powder), a natural mica powder whose particles surfaces are coated with a metal (i.e., a metallized natural mica powder), an ultrafine metal powder having an average particle diameter of from 0.01 to 5 μm, a resin powder whose particles surfaces are coated with a metal and a mixture of any of these. Of the above conductive particles, the metallized ceramic powder and the metallized natural mica powder are particularly preferred when the ED film is applied as a decorative coating film. This is because, when deposited together with resin, they can facilitate complete curing of the electro-deposition coating at a low temperature of from 90° C. to 100° C., which is usually required to be 130° C. to 180° C. as a heating temperature when the coating is cured by heat treatment after completion of electro-deposition, so that they enables achievement of firmer adhesion to the substrate.

Although it is unclear why these metallized ceramic powder and metallized natural mica powder, or a mixture thereof, have an excellent adhesion and can facilitate the low-temperature curing, it can be presumed that these powders are different from metal particles whose surfaces are susceptible to immediate oxidation, and can stably maintain the active points on the particle surfaces of the powder by the mutual action between the particle surface and the metal coating, so that the active points serve as cross-link points at the time of curing to accelerate the curing of the electro-deposition coating and also enable more formation of chemical bonds to the chemically colored film.

The metallized ceramic powder or metallized natural mica powder used in the present invention may include a ceramic powder or natural mica powder whose particles surfaces are coated with Cu, Ni, Ag, Au, Sn or the like. For the coating of the particle surfaces of these powders, Cu, Ag and Ni can be preferably used in view of the shielding performance and the cost. As a method for the coating of the powder particle surfaces, it is suited to use electroless plating. A superior shielding performance and good coating film properties at the time of low-temperature curing can be obtained when the powder particle surfaces are coated in a coating thickness of from 0.05 μm to 3 μm, and particularly from 0.15 μm to 2 μm. Formation of coating with thickness of more than 3 μm makes the surface properties analogous to those of metal particles , so that the coatings are oxidized in the air because of their very active surfaces to bring about a decrease in the active points that contribute the cross-linking, tending top result in an insufficient curing of the electro-deposition coating at the time of low-temperature baking.

When Ni coatings are formed on the powder particles, the method as disclosed, for example, in Japanese Patent Application Laid-open No. 61-276979 can be used, according to which a water-based suspension of the powder is prepared, and then an aged solution for electroless nickel plating is added to the suspension to form nickel coating on the powder particle surfaces so that Ni coating with a low phosphorus content, e.g., of 5% or less can be applied. Thus it is possible to form an electro-deposition coating having an improved conductivityn and substantially the same shielding properties as in Cu-coated powder.

The ceramic powder and the natural mica powder may preferably have an average particle diameter of from 0.1 μm to 5 μm, particularly from 0.15 μm to 3 μm, and more preferably from 0.5 μm to 2 μm, taking account of the surface area contributory to its surface activity and the dispersibility in an electro-deposition coating composition.

The ceramic used in the present invention may include, for example, aluminum oxide, titanium nitride, manganese nitride, tungsten nitride, tungsten carbide, lanthanum nitride, aluminum silicate, molybdenum disulfide, titanium oxide and silica. The natural mica may include phlogopite, serisite and muscovite.

As the conductive particles, in adddition to the above, it is also possible to use, as previously described, an ultrafine metal powder having an average particle diameter of from 0.01 to 5 μm and a resin powder having an average particle diameter of from 0.1 to 5 μm whose particles surfaces are metallized. For example, the ultrafine metal powder may include powders of Ag, Co, Cu, Fe, Mn, Ni, Pd, Sn, Te, etc. obtained by heat plasma evaporation, which may preferably have an average particle diameter ranging from 0.01 μm to 5 μm, particularly from 0.01 μm to 0.1 μm, and more preferably from 0.03 μm to 0.07 μm. Powder with an average particle diameter of less than 0.01 μm may cause secondary agglomeration. On the other hand, powder with an average particle diameter more than 5 μm may result in sedimentation of particles in an electro-deposition coating composition, and also may give a metallic gloss to a coated member, bringing about a difficulty in forming a coating in the desired color.

The metallized resin powder also usable in the present invention can be obtained by forming Cu or Ni coatings in a thickness of from 0.05 μm to 3 μm as in the case of the ceramic powder, on powder particle surfaces of a resin including fluorine resins, polyethylene resins, acrylic resins, polystyrene resins and nylons. This resin powder may also preferably have an average particle diameter of from about 0.1 μm to about 5 μm.

Figure 3:
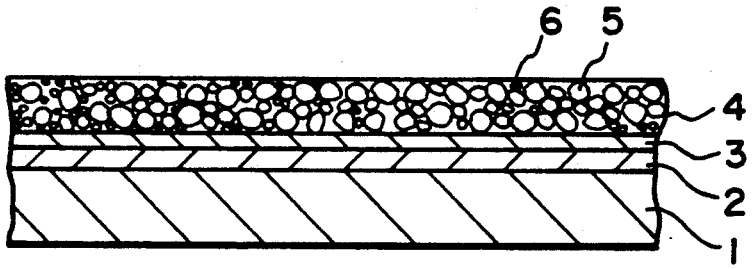
FIG. 3 is a schematic partial cross-section to diagrammatically illustrate an electroo-deposition coating film 4 of the electro-deposition coated member shown in FIG. 1 or 2.

Any of the conductive particles described above may be incorporated alone into the electro-deposition coating. It is thus possible to obtain an electro-deposition coated member with electromagnetic wave shielding properties and good coating film properties. When the ultrafine metal powder or the metallized resin powder, or a mixture of these, is added to the metallized ceramic powder or the metallized natural mica powder, or a mixture of these, in a weight proportion of the latter to the former of 1:0.2 to 3, the gaps between particles 5 of the metallized ceramic powder and/or metallized natural mica powder in the electro-deposition coating are filled with particles 6 of the ultrafine metal powder and/or metallized resin powder as shown in FIG. 3, to increase contact areas between each powder, so that the shielding properties can be more improved and also an electro-deposition coated member having a superior coating film properties and having a better adhesion to the substrate can be obtained even in the low-temperature heat treatment because of the action of the metallized ceramic powder and/or metallized natural mica powder.

In the present invention, any resins conventionally used in electro-deposition coating can be used as the resin feasible for electro-deposition, including, for example, in the case of an anionic electro-deposition coating composition, a resin having an anionic functional group such as a carboxyl group in order to impart negative charges and hydrophilicity which are necessary for the electro-deposition of the resin, specifically including acrylic melamine resins, acrylic resins, alkyd resins, maleinized polybutadiene and half esters or half amides of these. In the case of a cationic electro-deposition coating composition, the resin may include a resin having a cationic functional group such as an amino group in order to impart positive charges and hydrophilicity, specifically including epoxy resins, urethane resins, polyester resins and polyether resins. Of these resins, those having no self-crosslinking properties can be used in a mixture with a curing agent, for example, a melamine resin and a block polyisocyanate compound. It is possible to use not only heat-curable resins but also resins curable by energy of radiations such as ultraviolet rays and electron rays.

The content (herein "deposition quantity") of the conductive particles in the electro-deposition coating film of the present invention may preferably be in the range from 5% by weight to 50% by weight, particularly from 10% by weight to 30% by weight, and more preferably from 15% by weight to 25% by weight, in the electro-deposition coating film after curing. Such a content is preferred in order to attain an attenuation of, for example, 70 dB or more in the electromagnetic wave shielding performance and also taking account of the adhesion of the coating film as a decorative coating film to the substrate and the flexibility of the coating film. A content more than 50% by weight may bring about a brittle coating film, which is unsuitable as an exterior coating film. A content less than 5% by weight can give no sufficient shielding performance. The deposition quantity of the conductive particles can be measured by determination using an X-ray microanalyzer and by thermogravimetric analysis.

A process for producing the electro-deposition coated member of the present invention, shown in FIG. 1, will be described below.

First, metallic coating is applied to the non-metal substrate, and the chemically colored film is further formed. There are no particular limitations on the non-metal substrate, and any plastic materials used in plastic housings for office automation machinery, home electric appliances, etc. can be used, which include, for example, ABS resins, polycarbonate resins, polyetherimide resins, glass fiber packed ABS resins and glass fiber packed polycarbonate resins.

As is carried out in the conventionally known coating on plastics, the non-metal substrate is subjected to etching and a catalytic treatment, e.g., a palladium treatment is carried out, followed by formation of the metal thin film.

The formation of the metal thin film on the above non-metal substrate may preferably be carried out by electroless plating or electrolytic plating.

Next, the chemically colored film is formed on the metal thin film. This chemically colored film can be formed by chemical treatment of the surface of the metal thin film.

More specifically, in the case when copper is used to form the metal thin film, a chemically colored film comprised of cupric oxide, copper carbonate, copper sulfide, ammonium copper hydroxide or cuprous oxide can be formed by a conventional method of treating a copper surface. For example, as previously described, when a cupric oxide film capable of giving an excellent adhesion of the electro-deposition coating film is used as the chemically colored film, it can be obtained by an alkali treatment, e.g., by immersing a substrate with a copper thin film in an aqueous solution of sodium hydroxide.

If the electro-deposition coating film is directly formed on the metal thin film formed of copper, the copper may dissolve into an electro-deposition coating composition and accumulate therein to adversely affect coating film properties. However, the copper can be prevented from dissolving when the electro-deposition coating is formed on the copper oxide film, the chemically colored film, so that no copper ions can be present in the electro-deposition coating composition.

Stated additionally, this chemically colored film should be formed as a thin film.

Figure 2:
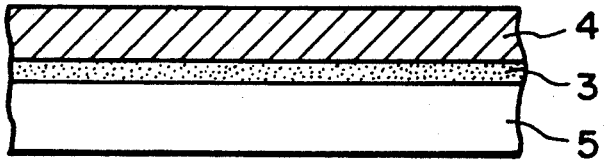
FIG. 2 is a schematic partial cross-section to show another embodiment of the electro-deposition coated member of the present invention.

In the present invention, besides the non-metal substrates, a substrate made of a metal can also be used as the substrate. Materials therefore include, for example, copper, iron, nickel, zinc and tin. In such an instance, as shown in FIG. 2, the chemically colored film 3 can be formed by subjecting a substrate 5 to a direct surface treatment. In the case when a substrate made of a metal other than copper is used, its surface may be plated with copper followed by an oxidation treatment, so that the chemically colored film comprised of copper oxide can be obtained. This is a preferred embodiment in view of an improvement in adhesion to the ED film 4.

Next, the substrate having been provided with the chemically colored film is immersed in an electro-deposition coating composition to carry out electro-deposition, thereby forming an electro-deposition coating on the chemically colored film.

This electro-deposition process may be carried out according to a conventional method for electro-deposition coating. For example, setting the substrate side as the anode when the resin used in the electro-deposition is anionic, and setting the substrate side as the cathode when the resin is cationic, the electro-deposition may be carried out under conditions of a bath temperature ranging from 20° C. to 25° C., an applied voltage of from 50 V to 200 V, a current density of from 0.5 $A/dm^2$ to 3 $A/dm^2$, a treatment time ranging from 1 minute to 5 minutes to deposit together the resin and the conductive particles on the chemically colored film, followed by washing with water and then heating to effect curing of the electro-deposition coating.

In the case when, for example, the metallized ceramic powder or the metallized natural mica powder, or a mixture of these, is used as the conductive particles, the above curing may be carried out in an oven at a low temperature of from 90° C. to 100° C. for 20 minutes to 180 minutes, so that sufficient curing can be effected. In the case when a usually available metal powder, the metallized resin powder or the ultrafine metal powder is used, the heating should be carried out at about 120° C. to about 180° C.

In this way, the electro-deposition coated member can be obtained to which the electromagnetic wave shielding properties have been imparted and at the same time an exterior coating has been applied.

In the present invention, taking account of the uniformity, adhesion and decorativeness of coating films, the electro-deposition coating film may preferably be formed as thinly as possible so long as the shielding properties can be ensured, and specifically may preferably be formed in a thickness of from 7 μm to 40 μm, and particularly from 10 μm to 25 μm.

The electro-deposition coating composition used in the manufacture of the electro-deposition coated member of the present invention will be described below.

The electro-deposition coating composition of the present invention is prepared, for example, by dispersing the conductive particles and the resin feasible for electro-deposition using a ball mill for about 24 hours to about 35 hours, followed by diluting the dispersion with desalted water to a concentration of solid contents of from 7% by weight to 15% by weight, and preferably from 10% by weight to 15% by weight. To this electro-deposition coating composition, a pigment or the like may optionally be added for the purpose of coloring. The pigment for coloring may be added in an amount of from 1% by weight to 3% by weight.

The conductive particles and the resin feasible for electro-deposition, contained in the electro-deposition coating composition, may preferably be in such a proportion that the conductive particles are in an amount of from 1 part by weight to 50 parts by weight, particularly from 10 parts by weight to 20 parts by weight, and more preferably from 7 parts by weight to 15 parts by weight, based on 100 parts by weight of the resin feasible for electro-deposition. When they are used in this range, conductive particles enough to impart shielding properties can be deposited, no conductive particles may be sedimented in the electro-deposition coating composition, and also the electro-deposition coating film can be made to have the coating film properties such as adhesion to substrates and flexibility of electro-deposition coating films.

As the conductive particles to be dispersed in the electro-deposition coating composition, it is possible to use powders deposited in the electro-deposition coating together with the resin, as exemplified by the powders previously described, i.e. the metallized ceramic powder, the metallized natural mica powder, or a mixture of these, and the powder comprised of a mixture of i) the metallized ceramic powder or the metallized natural mica powder, or a mixture of these, and ii) the ultrafine metal powder having an average particle diameter of from 0.01 μm to 7 μm and/or the resin powder having an average particle diameter of from 0.1 μm to 5 μm whose particles surfaces are coated with a metal.

As having been described above, according to the present invention, the chemically colored film is formed on the metal substrate or the non-metal substrate having been subjected to metal plating, and then the electro-deposition coating film containing the conductive particles is provided thereon. Thus it is possible to obtain an electro-deposition coated member more improved in the adhesion of the electro-deposition coating film to the substrate and the durability, and also having superior electromagnetic wave shielding properties.

The present invention also makes it possible to simultaneously carry out the two steps of decorative coating and of imparting electromagnetic wave shielding properties through one operation for electro-deposition, so that it is possible to produce a housing with electromagnetic wave shielding properties, without taking the complicated steps such that a conventional shielding treatment is carried out and a coating is provided thereon using a special coating composition.

The present invention further makes it possible to obtain an electro-deposition coated member with a superior adhesion to substrates and a superior durability even by a heat treatment carried out at a temperature as low as 90° C. to 100° C. Thus it is possible to form the conductive electro-deposition coating film of the present invention even on a plastic substrate having a low heat resistance, and also the electromagentic wave shielding electro-deposition coated member can be produced at a low energy. This is very effective from the viewpoint of cost.

Moreover, since the electro-deposition coated member of the present invention has the electro-deposition coating film having superior shielding properties, having at the same time a good adhesion and durability and being suitable for an exterior coating, it can be used as a housing for electronic machinery having therein electronic parts which are sources from which electromagnetic wave noises are generated, as exemplified by high voltage evolving devices such as electronic circuits, cathode ray tubes, motors and corona dischargers.

Figure 10:
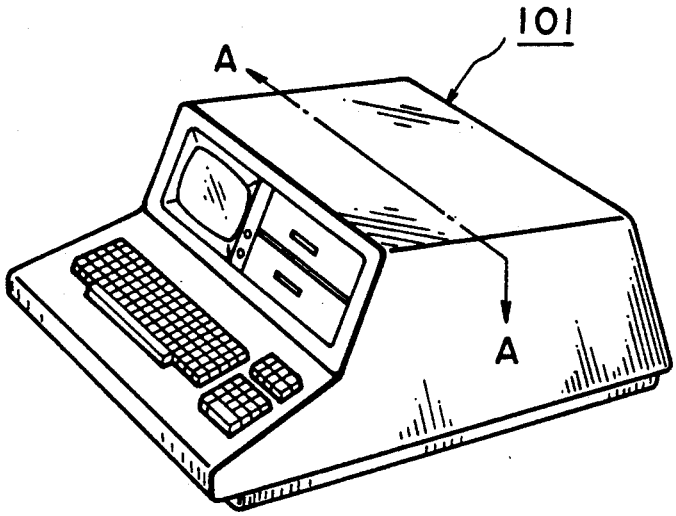
FIG. 10 is a perspective illustration of the appearance of one of electronic machinery according to the present invention.
Figure 11:
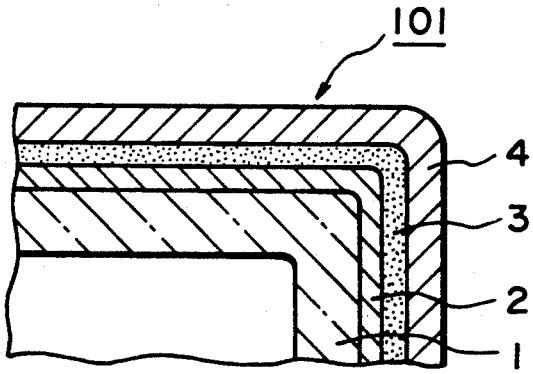
FIG. 11 is a cross-section along the line A—A' of the electronic machinery shown in FIG. 10.

Stated specifically, as shown in FIGS. 10 and 11, the electro-deposition coated member of the present invention can be used as a housing 101. Thus it is possible to intercept electromagnetic wave noises generated from electronic circuits. The chemically colored film 3 contributes a more improvement in the adhesion of the electro-deposition coating film 4 to the substrate 1. The electro-deposition coating film 4 is well usable as a decorative coating of the housing.

The present invention will be described below in greater detail by giving Examples.

In all Examples, the particle size of powder is measured with a centrifugal sedimentation particle size distribution measuring device (trade name: SACP-3; manufactured by Shimadzu Corporation). All powders are deemed to be comprised of dense spheres having the same particle diameters.

EXAMPLE 1-1

An ABS resin substrate (produced by Denki Kagaku Kogyo K. K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K. K.) of pH 13.0, plating was carried out at a bath temperature of 70° C. for 3 minutes to form a copper thin film of 0.1 μm thickness. Subsequently, using an aqueous solution of 5% of sodium hydroxide and 1% of potassium persulfate, the surface of the copper thin film was treated at 70° C. for 30 seconds to form a cupric oxide film, the chemically colored film.

Then, in 100 parts by weight of an acrylic melamine resin (trade name: Honey Bright C-IL; produced by Honey Chemical Co.) containing a curing agent, 10 parts by weight of alumina with an average particle diameter of 1 μm whose particle surfaces were coated with copper by electroless plating in a thickness of 2 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coated member was thus obtained.

The electro-deposition coating film (ED film) formed on this electro-deposition coated member had a coating thickness of 20 μm and a conductive particles deposition quantity of 35% by weight.

The adhesion of the ED film was examined according to the cross cut test prescribed in JIS-K 5400, in respect of the electro-deposition coated member thus obtained and the same electro-deposition coated member as herein obtained but immersed in hot water of 100° C., boiled for 1 hour and then dried for 2 hours. Cuts in a checkered pattern were made on the ED film of each coated member so as to give 100 checkers in 1 $cm^2$, and a cellophane tape was stuck thereon. After the cellophane tape was instantaneously peeled, the state of the coating film was observed to make evaluation on the basis of the number of the squares of the checkered pattern which remained without peeling of the coating film.

On the coated member not subjected to boiling, cuts that reached its metal thin film were made with a cutter to carry out the salt spray test prescribed in JIS-K 5400. The coated member with the cuts were left to stand in a salt spray tester for 200 hours, 350 hours, 500 hours or 650 hours, and then washed with water, followed by drying at room temperature for 2 hours. In respect of the resulting coated member, the one-side blister width at the cut portions of the coating film was measured to make evaluation on the corrosion resistance of the electro-deposition coated member. The results of the adhesion and corrosion resistance tests are shown in Tables 1-1 and 1-2.

COMPARATIVE EXAMPLE 1

The ABS resin substrate as used in Example 1-1 was subjected to electroless nickel plating to form a nickel thin film, and an electro-deposition coating film was provided thereon in the same manner as in Example 1-1 to give an electro-deposition coated member. The adhesion and corrosion resistance of the coating film were tested to obtain the results as shown in Tables 1-1 and 1-2.

COMPARATIVE EXAMPLE 2

On the copper thin film formed on the ABS resin substrate in Example 1-1, an electro-deposition coating film was provided in the same manner as in Example 1-1 except for providing no chemically colored film, to give an electro-deposition coated member. The adhesion and corrosion resistance of the coating film were tested to obtain the results as shown in Tables 1-1 and 1-2.

TABLE 1-1

| | Results of evaluation on adhesion | |
|---|---|---|
| | Before boiling | After boiling |
| Example 1-1 | 100/100 | 100/100 |
| Comparative Example: | | |
| 1-1 | 10/100 | 0/100 |
| 1-2 | 90/100 | 16/100 |

TABLE 1-2

| | Results of evaluation on corrosion resistance | | | |
|---|---|---|---|---|
| | Test time | | | |
| | 200 hrs | 350 hrs | 500 hrs | 650 hrs |
| Example 1-1 | 0 | 0 | 0 | 0.5 to 1 |
| Comparative Example: | | | | |
| 1-1 | 1 | 3 | 3 | 4 |
| 1-2 | 3 | Whole area blister | — | — |

Note: Results of evaluation are indicated as one-side blister width (mm) at the cut portions of the coating films.

As is seen from the results shown in Tables 1-1 and 1-2, the coating film of the electro-deposition coated member according to Example 1-1 showed an adhesion of 100/100 even after boiling and a corrosion resistance of 1 mm or less in terms of the one-side blister width, showing very good results compared with Comparative Examples 1-1 and 1-2.

Figure 4:
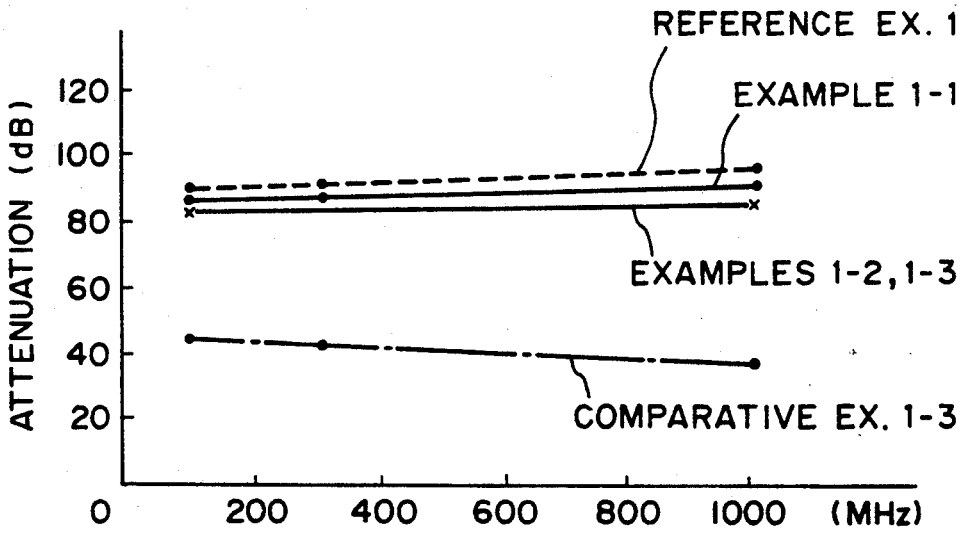
FIG. 4 shows comparison of shielding effect between Example 1, Reference Example 1 and Comparative Example 1 .

Next, in respect of the electro-deposition coated member of Example 1-1, its effect on electromagnetic wave shielding against electromagnetic waves having frequencies of from 50 to 1,000 MHz was measured according to the transmission line method (ASTM ES7-83 Method). Results obtained are shown in FIG. 4. As shown in FIG. 4, the electromagnetic wave shielding effect was obtained with a good value of about 85 to 95 dB as an attenuation, which cleared the VCCI regulations.

In Examples of the present invention, the deposition of the conductive particles was determined using an X-ray microanalyzer, and the deposition quantity was analyzed using a thermogravimetric analyzer (manufactured by Perkin Elmer Co., Thermal Analysis System 7 series).

EXAMPLE 1-2

An ABS resin substrate (produced by Denki Kagaku Kogyo K.K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K.K.) of pH 13.0, plating was carried out at a bath temperature of 70° C. for 3 minutes to form a copper thin film of 0.1 μm thickness. Subsequently, using an aqueous solution of 5% of sodium hydroxide and 1% of potassium persulfate, the surface of the copper thin film was treated at 70° C. for 30 seconds to form a cupric oxide film, the chemically colored film.

Then, in 100 parts by weight of an acrylic melamine resin (trade name: Honey Bright C-IL; produced by Honey Chemical Co.), 10 parts by weight of alumina with an average particle diameter of 1 μm whose particle surfaces were coated with copper by electroless plating in a thickness of 0.5 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coated member was thus obtained.

The electro-deposition coating film formed on this electro-deposition coated member had a coating thickness of 20 μm and a conductive particles deposition quantity of 35% by weight.

The adhesion and corrosion resistance of this coating film were evaluated in the same manner as in Example 1-1. The electromagnetic wave shielding effect was also similarly measured. Results obtained are shown in Table 1-3 and FIG. 4.

EXAMPLE 1-3

An ABS resin substrate (produced by Denki Kagaku Kogyo K.K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K.K.) of pH 13.0, plating was carried out at a bath temperature of 70° C. for 2 minutes to form a copper thin film of 0.1 μm thickness. Subsequently, using an aqueous solution of 5% of sodium hydroxide and 1% of potassium persulfate, the surface of the copper thin film was treated at 70° C. for 30 seconds to form a cupric oxide film, the chemically colored film.

Then, in 100 parts by weight of an acrylic melamine resin (trade name: Honey Bright C-IL; produced by Honey Chemical Co.), 10 parts by weight of alumina with an average particle diameter of 1 μm whose particle surfaces were coated with copper by electroless plating in a thickness of 0.2 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coated member was thus obtained.

The electro-deposition coating film formed on this electro-deposition coated member had a coating thickness of 25 μm and a conductive particles deposition quantity of 30% by weight.

The adhesion and corrosion resistance of this coating film were examined in the same manner as in Example 1-1. The electromagnetic wave shielding effect of the electro-deposition coated member was also similarly measured. Results obtained are shown in Table 1-3 and FIG. 4.

COMPARATIVE EXAMPLE 1-3

To the ABS resin substrate as used in Example 1-1, nickel powder with an average particle diameter of 10 μm was sprayed by spray coating to form a nickel spray coating film with a thickness of 70 μm.

The electromagnetic wave shielding effect of a member on which this nickel spray coating film was formed was measured in the same manner as in Example 1-1. Results obtained are shown in Table 1-3 and FIG. 4. As is seen from the results, the nickel powder has been insufficiently dispersed and no satisfactory shielding performance can be ensured.

REFERENCE EXAMPLE 1

The ABS resin substrate as used in Example 1-1 was subjected to electroless copper and nickel plating to form successively thereon a copper film in a thickness of 0.7 μm and a nickel film in a thickness of 0.4 μm, to give a metal coated member.

The electromagnetic wave shielding effect of this metal coated member was measured in the same manner as in Example 1-1. Results obtained are shown in Table 1-3 and FIG. 4.

As is seen from the results shown in Table 1-3 and FIG. 4, a good value of 90 dB as an attenuation can be obtained in regard to the electromagnetic wave shielding performance, when the copper coating is formed in a relatively large thickness.

TABLE 1-3

| | Adhesion | | Corrosion resistance*1 | | | | |
|---|---|---|---|---|---|---|---|
| | Before boiling | After boiling | 200 hrs | 350 hrs | 500 hrs | 650 hrs | EMS*2 |
| Example: | | | | | | | |
| 1-2 | 100/100 | 100/100 | 0 | 0 | 0 | 0 | A |
| 1-3 | 100/100 | 100/100 | 0 | 0 | 0 | 0.5 | A |
| Comparative Example: 1-3 | | | — | — | — | — | D |
| Reference Example: 1 | — | — | — | — | — | — | AA |

*1One-side blister width (mm) at the cut portions of coating films.
*2Electromagnetic wave shielding performance:
AA: Attenuation of not less than 90 dB
A: Attenuation of from 80 dB to less than 90 db
B: Attenuation of from 75 dB to less than 80 db
C: Attenuation of from 70 dB to less than 75 db
D: Attenuation of not more than 50 db

EXAMPLE 2-1

The Abs resin substrate as used in Example 1-1 was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K.K.) of pH 13.0, plating was carried out at a bath temperature of 70° C. for 3 minutes to form a copper thin film of 0.2 μm thickness. Subsequently, using an aqueous solution of 5% of sodium hydroxide and 1% of potassium persulfate, the surface of the copper thin film was treated at 70° C. for 30 seconds to form a cupric oxide film, the chemically colored film.

Separately, the following electro-deposition coating compositions (1) to (3) were prepared: (1) A solution comprised of 100 parts by weight of an acrylic melamine resin (trade name: Honey Bright C-IL; produced by Honey Chemical Co.) containing a curing agent. (2) In 100 parts by weight of the same acrylic melamine resin, 5 parts by weight of a nickel powder with an average particle diameter of 0.1 μm and 7 parts by weight of alumina with an average particle diameter of 1.0 μm whose particle surfaces were coated with nickel by electroless plating in a thickness of 0.2 μm were dispersed. (3) In 100 parts by weight of the same resin, 7 parts by weight of a copper powder with an average particle diameter of 0.1 μm and 7 parts by weight of alumina with an average particle diameter of 0.7 μm whose particle surfaces were coated with copper by electroless plating in a thickness of 0.2 μm were dispersed. The resulting solution and dispersions were each diluted with desalted water to 15% by weight as concentration of solid contents.

Figure 5:
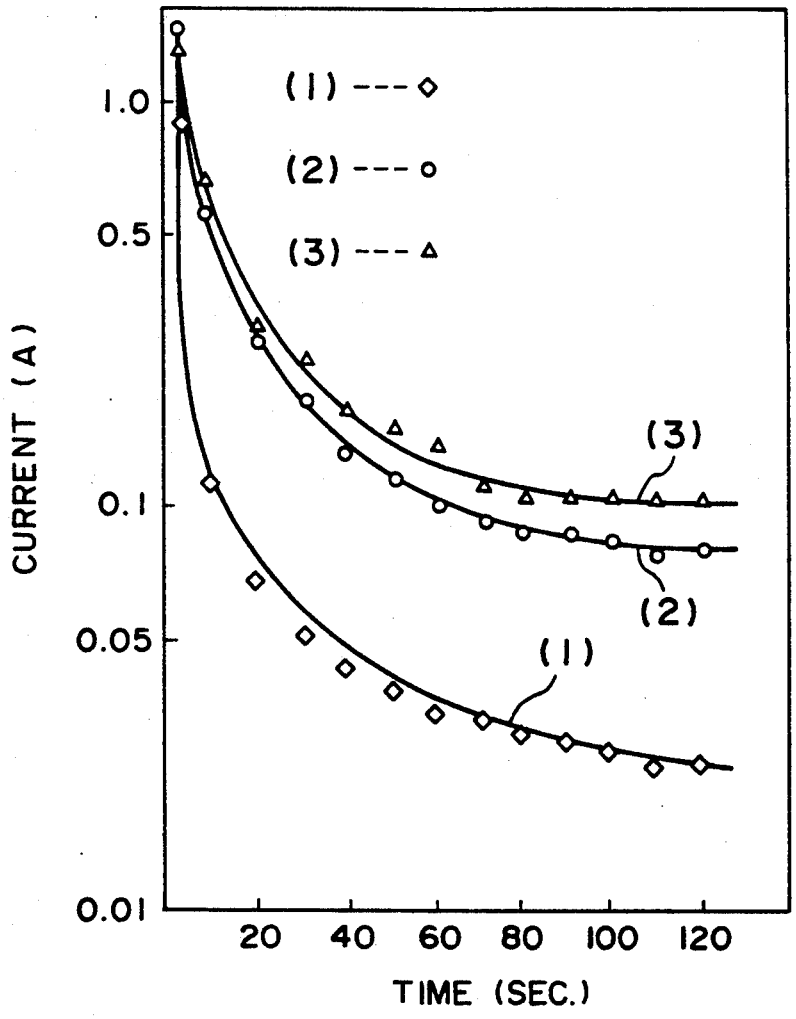
FIG. 5 shows current-time curves of an electro-deposition coating composition containing an electro-deposition resin or an electro-deposition resin and conductive particles.

The above ABS resin substrate was immersed in the electro-deposition coating composition (1), (2) or (3), followed by electro-deposition at an applied voltage of 120 V for 3 minutes. Electro-deposition coated members were thus prepared, each having a conductive particles deposition quantity of 0% by weight, 25% by weight or 30% by weight. FIG. 5 shows current-time curves corresponding to the respective electro-deposition steps.

The results show that the coating composition in which a mixture of the ultrafine metal powder and metallized ceramic powder were dispersed causes no abrupt attenuation of electric currents as time lapses and the coating formed by the deposition has a high conductivity, compared with the solution comprised of the resin only.

Figure 6:
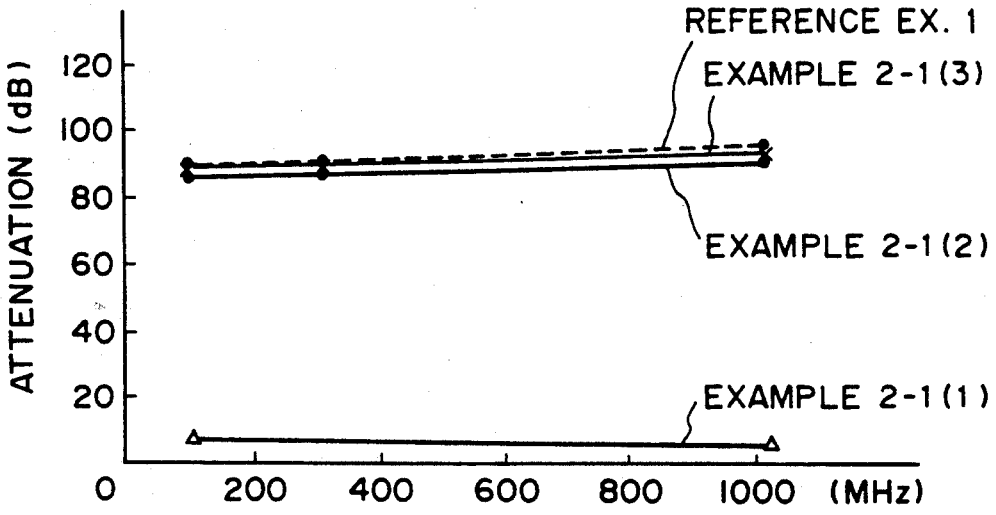
FIGS. 6 to 9 show shielding effects of Example 2-1, Example 4, Example 5 and Example 6, respectively.

The above three kinds of coated articles were washed with water and then heated in an oven of 93° C.±1° C. for 100 minutes to effect curing. Electro-deposition coated members (1), (2) and (3) thus obtained were evaluated on their adhesion, corrosion resistance and electromagnetic wave shielding performance in the same manner as in Example 1-1. Results obtained are shown in Table 2-1 and FIG. 6.

As will be seen from the results, the electro-deposition coating film containing the mixture of the ultrafine metal powder and metallized ceramic powder shows superior coating film properties even when cured at a low temperature, and also give a very good electromagnetic wave shielding performance. On the other hand, The electro-deposition coated member (1) obtained by electro-deposition of the resin only showed a quite unsatisfactory curing of the electro-deposition coating at a low temperature of 93° C.±1° C., resulting in a poor adhesion of the coating to the substrate. In respect of the electromagnetic wave shielding performance, the copper coating in a thickness of 0.2 μm was found to give quite unsatisfactory results.

The nickel coatings on the alumina particle surfaces in the present Example 2-1(2) were so formed as to give a phosphorus content of not more than 5%.

EXAMPLE 2-2

A polycarbonate substrate was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K. K.) of pH 13.0, plating was carried out at a bath temperature of 70° C. for 3 minutes to form a copper thin film of 0.2 μm thickness. Subsequently, using an aqueous solution of 5% of sodium hydroxide and 1% of potassium persulfate, the surface of the copper thin film was treated at 70° C. for 30 seconds to form a cupric oxide film, the chemically colored film.

Then, in 100 parts by weight of an acrylic melamine resin (trade name: Honey Bright C-IL; produced by Honey Chemical Co.), 5 parts by weight of a nickel powder with an average particle diameter of 0.05 μm and 5 parts by weight of alumina with an average particle diameter of 2 μm whose particle surfaces were coated with nickel by electroless plating in a thickness of 0.5 μm were dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5t stainless steel sheet as the opposing electrode. After the electro-deposition, the coated article was washed with water and then heated in an oven of 97° C.±1° C. for 60 minutes to effect curing. An electro-deposition coated member with a good appearance was thus obtained.

The electro-deposition coating film formed on this electro-deposition coated member had a coating thickness of 20 μm and a conductive particles deposition quantity of 30% by weight.

The adhesion and corrosion resistance of the resulting electro-deposition coating film and the electromagnetic wave shielding performance of the electro-deposition coated member were evaluated in the same manner as in Example 1-1.

EXAMPLE 2-3

An ABS resin substrate (produced by Denki Kagaku Kogyo K. K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K. K.) of pH 13.0, plating was carried out at a bath temperature of 70° C. for 3 minutes to form a copper thin film of 0.2 μm thickness. Subsequently, using an aqueous solution of 5% of sodium hydroxide and 1% of potassium persulfate, the surface of the copper thin film was treated at 70° C. for 1 minute to form a cupric oxide film, the chemically colored film.

Then, in 100 parts by weight of an acrylic melamine resin (trade name: Honey Bright C-IL; produced by Honey Chemical Co.), 6 parts by weight of a copper powder with an average particle diameter of 0.05 μm and 4 parts by weight of alumina with an average particle diameter of 1 μm whose particle surfaces were coated with copper by electroless plating in a thickness of 0.5 μm were dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 120 V for 3 minutes under conditions of a bath temperature of 25° C. and pH 8 to 9, setting the article to be coated as the anode and a 0.5t stainless steel sheet as the opposing electrode. After the electro-deposition, the coated article was washed with water and then heated in an oven of 97° C.±1° C. for 60 minutes to effect curing. An electro-deposition coated member with a good appearance was thus obtained.

The electro-deposition coating film formed on this electro-deposition coated member had a coating thickness of 15 μm and a conductive particles deposition quantity of 30% by weight. The same tests as in Example 1-1 were also carried out using this electro-deposition coated member.

EXAMPLE 2-4

An ABS resin substrate (produced by Denki Kagaku Kogyo K. K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K. K.) of pH 13.0, plating was carried out at a bath temperature of 70° C. for 3 minutes to form a copper thin film of 0.2 μm thickness. Subsequently, using an aqueous solution of 5% of sodium hydroxide and 1% of potassium persulfate, the surface of the copper thin film was treated at 70° C. for 1 minute to form a cupric oxide film, the chemically colored film.

Then, in 100 parts by weight of an acrylic melamine resin (trade name: Honey Bright C-IL; produced by Honey Chemical Co.), 5 parts by weight of a nickel powder with an average particle diameter of 0.07 μm and 7 parts by weight of silicon carbide with an average particle diameter of 1 μm whose particle surfaces were coated with copper by electroless plating in a thickness of 0.5 μm were dispersed for 30 hours using a ball mill, and then the dispersion was diluted with desalted water to 5% by weight, followed by further addition of 2.0% by weight of carbon black for the purpose of coloring to make up a coating composition. Using this coating composition, electro-deposition was carried out at an applied voltage of 100 V for 3 minutes under conditions of a bath temperature of 25° C. and pH 8 to 9, setting the article to be coated as the anode and a 0.5t stainless steel sheet as the opposing electrode. After the electro-deposition, the coated article was washed with water and then heated in an oven of 97° C.±1° C. for 60 minutes to effect curing. An electro-deposition coated member with a good appearance was thus obtained.

The electro-deposition coating film formed on this electro-deposition coated member had a coating thickness of 10 μm and a conductive particles deposition quantity of 10% by weight. The same tests as in Example 1-1 were also carried out using this electro-deposition coated member.

EXAMPLE 2-5

A brass plate (100 mm×50 mm×0.7 mm) was subjected to plating pretreatments such as solvent degreasing and electrolytic degreasing. Subsequently, using an aqueous solution of 5% of sodium hydroxide and 1% of potassium persulfate, the surface of the brass plate was treated at 70° C. for 1 minute to form a cupric oxide film.

Then, in 100 parts by weight of an acrylic melamine resin (trade name: Honey Bright C-IL; produced by Honey Chemical Co.), 10 parts by weight of a nickel powder with an average particle diameter of 0.05 μm and 3 parts by weight of alumina with an average particle diameter of 1 μm whose particle surfaces were coated with nickel by electroless plating in a thickness of 0.5 μm were dispersed for 30 hours using a ball mill, and then the dispersion was diluted with desalted water to 15% by weight as a concentration of solid contents, followed by addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coated member with a good appearance was thus obtained.

The electro-deposition coating film formed on this electro-deposition coated member had a coating thickness of 20 μm and a conductive particles deposition quantity of 40% by weight. The same tests as in Example 1-1 were also carried out using this electro-deposition coated member.

Results obtained in the above are shown in Table 2-1.

TABLE 2-1

| | Adhesion | | Corrosion resistance | | | | |
|---|---|---|---|---|---|---|---|
| Example: | Before boiling | After boiling | 200 hrs | 350 hrs | 500 hrs | 650 hrs | EMS* |
| 2-1 | | | | | | | |
| (1) | 1/100 | — | 0 | 0 | 0 | 1 | D |
| (2) | 100/100 | 100/100 | 0 | 0 | 0 | 0.5 to 1 | AA |
| (3) | 100/100 | 100/100 | 0 | 0 | 0 | 0 | AA |
| 2-2 | 100/100 | 100/100 | 0 | 0 | 0 | 0 | AA |
| 2-3 | 100/100 | 100/100 | 0 | 0 | 0 | 0 | AA |
| 2-4 | 100/100 | 98/100 | 0 | 0 | 0 | 0 | A |
| 2-5 | 100/100 | 100/100 | 0 | 0 | 0 | 0 | AA |

*Electromagnetic wave shielding performance

EXAMPLE 3-1

An ABS resin substrate (produced by Denki Kagaku Kogyo K. K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K. K.) of pH 13.0, plating was carried out at a bath temperature of 70° C. for 3 minutes to form a copper thin film of 0.2 μm thickness. Subsequently, using an aqueous solution comprising a mixture of 5% of copper sulfate and 1% of sodium chloride, the surface of the copper thin film was treated at 70° C. for 30 seconds to form a cuprous oxide film, the chemically colored film.

Then, in 100 parts by weight of an acrylic melamine resin (trade name: Honey Bright C-IL; produced by Honey Chemical Co.), 10 parts by weight of a natural mica powder with an average particle diameter of 2.0 μm whose particle surfaces were coated with copper by electroless plating in a thickness of 0.2 μm and 15 parts by weight of a nickel powder (produced by Tokyo Tekko K. K.) with an average particle diameter of 0.05 μm were dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coated member with a good appearance was thus obtained.

The electro-deposition coating film formed on this electro-deposition coated member had a coating thickness of 20 μm and a conductive particles deposition quantity of 30% by weight.

EXAMPLE 3-2

An ABS resin substrate (produced by Denki Kagaku Kogyo K. K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K. K.) of pH 13.0, plating was carried out at a bath temperature of 70° C. for 10 minutes to form a copper thin film of 0.2 μm thickness. Subsequently, using an aqueous solution of 5% of sodium hydroxide and 1% of potassium persulfate, the surface of the copper thin film was treated at 70° C. for 1 minute to form a cupric oxide film, the chemically colored film.

Then, in 100 parts by weight of an acrylic melamine resin (trade name: Honey Bright C-IL; produced by Honey Chemcial Co.), 10 parts by weight of an alumina powder with an average particle diameter of 1 μm whose particle surfaces were coated with copper by electroless plating in a thickness of 0.2 μm, 5 parts by weight of a natural mica powder with an average particle diameter of 2 μm whose particle surfaces were coated with copper by electroless plating in a thickness of 0.2 μm and 15 parts by weight of a copper powder (produced by Tokyo Tekko K. K.) with an average particle diameter of 0.02 μm were dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied voltage of 120 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coated member with a good appearance was thus obtained.

The electro-deposition coating film formed on this electro-deposition coated member had a coating thickness of 20 μm and a conductive particles deposition quantity of 35% by weight.

EXAMPLE 3-3

An ABS resin substrate (produced by Denki Kagaku Kogyo K. K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K.K.) of pH 13.0, plating was carried out at a bath temperature of 70° C. for 3 minutes to form a copper thin film of 0.2 μm thickness. Subsequently, using an aqueous solution comprising a mixture of 5% of ammonium chloride and 1% of potassium sulfide, the surface of the copper thin film was treated at 70° C. for 1 minute to form a copper sulfide film, the chemically colored film.

Then, in 100 parts by weight of an acrylic melamine resin (trade name: Honey Bright C-IL; produced by Honey Chemical Co.), 20 parts by weight of an alumina powder with an average particle diameter of 1 μm whose particle surfaces were coated with copper by electroless plating in a thickness of 0.05 μm, 15 parts by weight of a natural mica powder with an average particle diameter of 2 μm whose particle surfaces were coated with copper by electroless plating in a thickness of 0.2 μm, 15 parts by weight of a nylon powder with an average particle diameter of 1 μm whose particle surfaces were coated with nickel by electroless plating in a thickness of 0.2 μm and 10 parts by weight of a silver powder with an average particle diameter of 0.07 μm were dispersed for 30 hours using a ball mill, and then the dispersion was diluted with desalted water to 5% by weight as a concentration of solid contents, followed by further addition of 2.0% by weight of carbon black for the purpose of coloring to make up a coating composition. Using this coating composition, electro-deposition was carried out at an applied voltage of 100 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 97° C.±1° C. for 60 minutes to effect curing. An electro-deposition coated member with a good appearance was thus obtained.

The electro-deposition coating film formed on this electro-deposition coated member had a coating thickness of 15 μm and a conductive particles deposition quantity of 20% by weight.

The above electro-deposition coated members of Examples 3-1 to 3-3 were evaluated on their adhesion, corrosion resistance and electromagnetic wave shielding performance in the same manner as in Example 1-1. Results obtained are shown in Table 3-1.

TABLE 3-1

| | Adhesion | | Corrosion resistance | | | | |
|---|---|---|---|---|---|---|---|
| Example: | Before boiling | After boiling | 200 hrs | 350 hrs | 500 hrs | 650 hrs | EMS* |
| 3-1 | 100/100 | 100/100 | 0 | 0 | 0 | 0 | AA |
| 3-2 | 100/100 | 100/100 | 0 | 0 | 1 | 1.5 | AA |
| 3-3 | 100/100 | 100/100 | 0 | 0 | 0 | 0.5 | AA |

*Electromagnetic wave shielding performance

EXAMPLE 4-1

An ABS resin substrate (produced by Denki Kagaku Kogyo K. K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using an activator solution containing 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K. K.) of pH 13.0, plating was carried out at a bath temperature of 70° C. for 3 minutes to form a copper thin film of 0.1 μm thick. Subsequently, using an aqueous solution of 5% of sodium hydroxide and 1% of potassium persulfate, the surface of the copper thin film was treated at 70° C. for 30 seconds to form a cupric oxide film, the chemically colored film.

Then, in 100 parts by weight of an acrylic melamine resin (trade name: Honey Bright C-IL; produced by Honey Chemical Co.), 10 parts by weight of a nickel powder with an average particle diameter of 0.03 μm was dispersed for 30 hours using a ball mill, and then the dispersion was diluted with desalted water to 15% by weight as a concentration of solid contents, followed by further addition of 1.0% by weight of carbon black for the purpose of coloring to make up a coating composition. Using this coating composition, electro-deposition was carried out at an applied voltage of 150 V for 30 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 145° C.±1° C. for 60 minutes to effect curing. An electro-deposition coated member with a good appearance was thus obtained.

The electro-deposition coating film formed on this electro-deposition coated member had a conductive particles deposition quantity of 25% by weight and a coating thickness of 20 μm.

In respect ot this electro-deposition coated member, the adhesion, corrosion resistance and electromagnetic wave shielding effect of the electro-deposition coating film were evaluated in the same manner as in Example 1-1. Results obtained are shown in Table 4-1.

EXAMPLE 4-2

An ABS resin substrate (produced by Denki Kagaku Kogyo K. K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K. K.) of pH 13.0, plating was carried out at a bath temperature of 70° C. for 10 minutes to form a copper thin film of 0.2 μm thickness. Subsequently, using an aqueous solution of 5% of sodium hydroxide and 1% of potassium persulfate, the surface of the copper thin film was treated at 70° C. for 30 seconds to form a cupric oxide film, the chemically colored film.

Then, in 100 parts by weight of an acrylic melamine resin (trade name: Honey Bright C-IL; produced by Honey Chemical Co.), 10 parts by weight of a copper powder with an average particle diameter of 0.05 μm was dispersed for 30 hours using a ball mill, and then the dispersion was diluted with desalted water to 15% by weight as a concentration of solid contents, followed by further addition of 0.5% by weight of carbon black for the purpose of coloring to make up a coating composition. Using this coating composition, electro-deposition was carried out at an applied voltage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 145° C.±1° C. for 60 minutes to effect curing. An electro-deposition coated member was thus obtained.

The ED film formed on this electro-deposition coated member has a coating thickness of 25 μm and a conductive particles deposition quantity of 25% by weight.

In respect of this electro-deposition coated member, the adhesion, corrosion resistance and electromagnetic wave shielding effect of the ED film were evaluated in the same manner as in Example 1.

EXAMPLE 4-3

An ABS resin substrate (produced by Denki Kagaku Kogyo K. K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloric acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K. K.) of pH 13.0, plating was carried out at a bath temperature of 70° C. for 3 minutes to form a copper thin film of 0.2 μm thickness. Subsequently, using an aqueous solution of 5% of sodium hydroxide and 1% of potassium persulfate, the surface of the copper thin film was treated at 70° C. for 30 seconds to form a cupric oxide film, the chemically colored film.

Then, in 100 parts by weight of an acrylic melamine resin (trade name: Honey Bright C-IL; produced by Honey Chemical Co.), 15 parts by weight of a nickel powder with an average particle diameter of 0.01 μm was dispersed for 30 hours using a ball mill, and then the dispersion was diluted with desalted water to 15% by weight as a concentration of solid contents, followed by further addition of 1.0% by weight of carbon black for the purpose of coloring to make up a coating composition. Using this coating composition, electro-deposition was carried out at an applied voltage of 120 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 145° C.±1° C. for 60 minutes to effect curing. An electro-deposition coated member was thus obtained.

The ED film formed on this electro-deposition coated member had a coating thickness of 18 μm and a conductive particles deposition quantity of 20% by weight.

In respect of this electro-deposition coated member, the adhesion, corrosion resistance and electromagnetic wave shielding effect of the ED film were evaluated in the same manner as in Example 1.

EXAMPLE 4-4

An ABS resin subtrate (produced by Denki Kagaku Kogyo K.K.) was treated with an etchant of a $CrO_3$—$H_2SO_4$—$H_2O$ system for 1 minute. After washing with water, the resulting substrate was treated at room temperature for 2 minutes using as a sensitizer solution a solution comprised of 30 g/lit. of stannous chloride and 20 ml/lit. of hydrochloirc acid and washed with water. Subsequently, using as an activator solution a solution comprised of 0.3 g/lit. of palladium chloride and 3 ml/lit. of hydrochloric acid, the substrate was further treated at room temperature for 2 minutes to make its surface conductive. Thereafter, using an electroless copper plating solution (produced by Okuno Seiyaku Kogyo K.K.) of pH 13.0, plating was carried out at a bath temperature of 70° C. for 2 minutes to form a copper thin film of 0.1 μm thickness. Subsequently, using an aqueous solution of 5% of sodium hydroxide and 1% of potassium persulfate, the surface of the copper thin film was treated at 70° C. for 30 seconds to form a cupric oxide film, the chemically colored film.

Then, in 100 parts by weight of an acrylic melamine resin (trade name: Honey Bright C-IL; produced by Honey Chemical Co.), 10 parts by weight of a sliver powder with an average particle diameter of 0.05 μm was dispersed for 30 hours using a ball mill, and then the dispersion was diluted with desalted water to 15% by weight as a concentration of solid contents, followed by further addition of 2.0% by weight of carbon black for the purpose of coloring to make up a coating composition. Using this coating composition, electro-deposition was carried out at an applied vlotage of 150 V for 3 minutes under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 145° C.±1° C. for 60 minutes to effect curing. An electro-deposition coated member was thus obtained.

The ED film formed on this electro-deposition coated member has a coating thickness of 20 μm and a conductive particles deposition quantity of 20% by weight.

In respect of this electro-deposition coated member, the adhesion, corrosion resistance and electromagnetic wave shielding effect of the ED film were evaluated in the same manner as in Example 1.

COMPARATIVE EXAMPLES 4-1

An electro-deposition coated member was obtained in the same manner as in Exmple 4-1 except that the nickle powder used in the electro-deposition coating composition of Example 4-1 was replaced with a nickel power with an average particle diameter of 10 μm.

Using this electro-deposition coated member, the adhesion and corrosion resistance were tested in the same manner as in Example 4-1.

Figure 7:
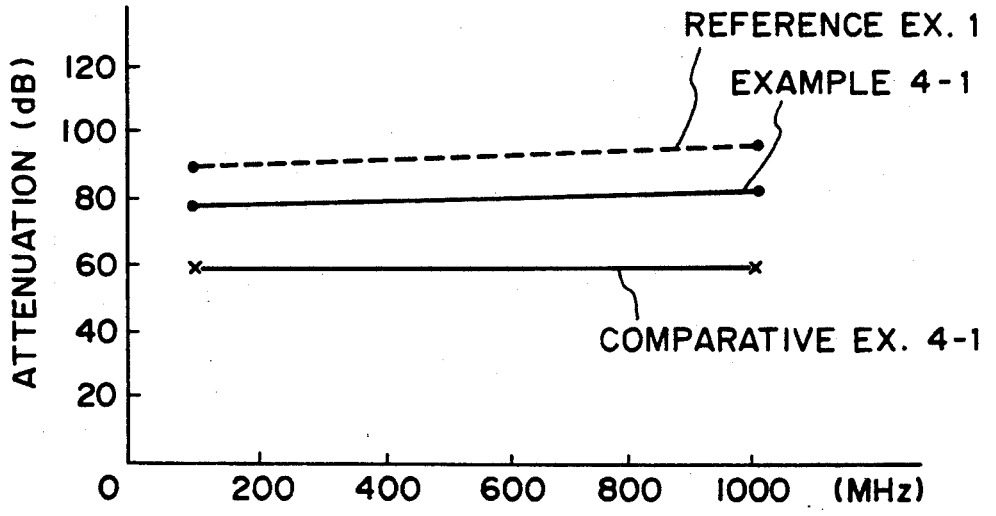
Figure 8:
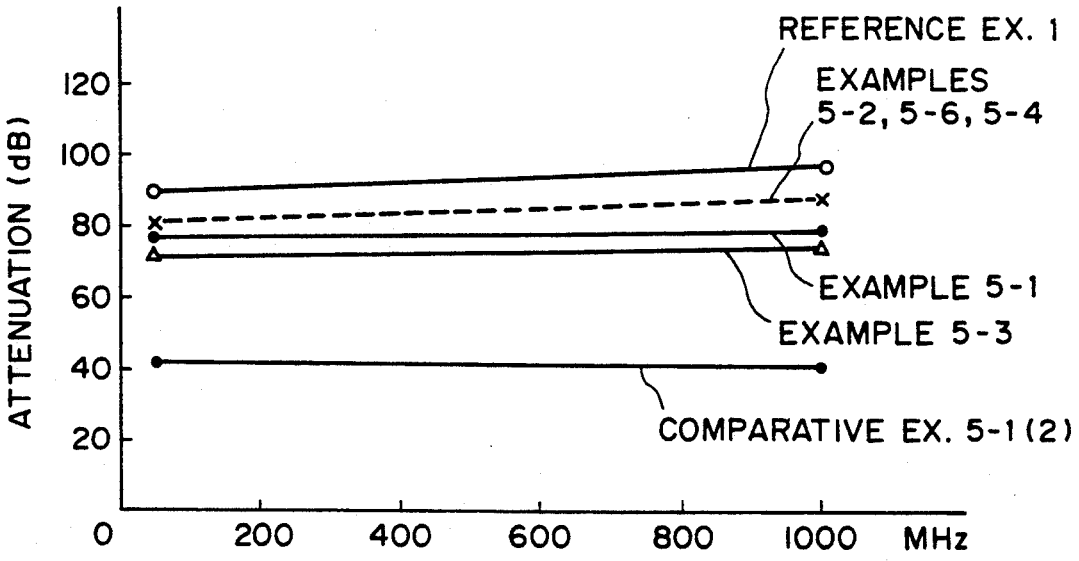
Figure 9:
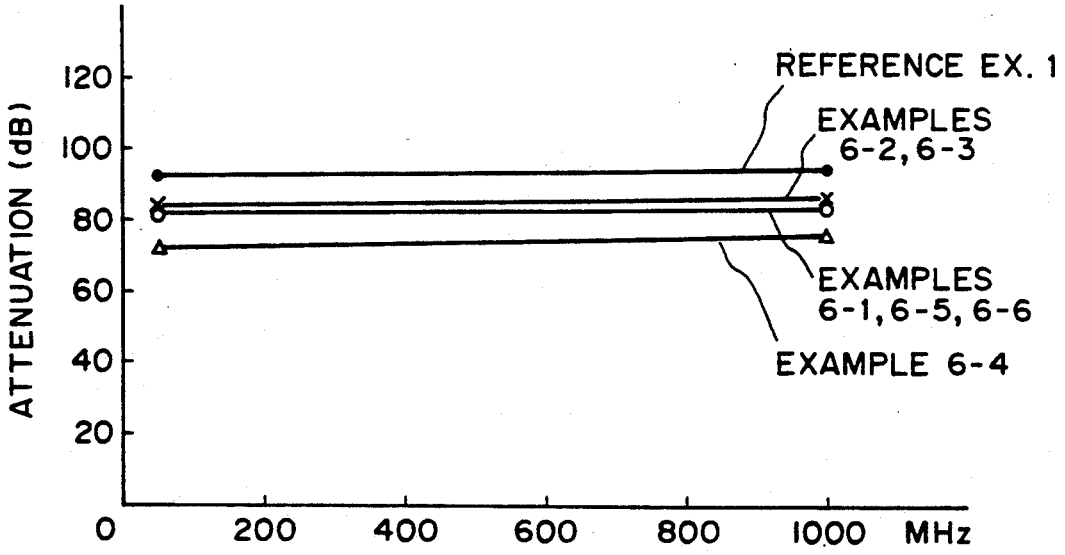

The electromagnetic wave shielding effect was also measured in the same manner as in Example 4-1. Results obtained are shown in FIG. 7. As shown in FIG. 7, the electromagnetic wave shielding effect is seen to be poorer than that of Example 4-1.

Results of evaluation regarding the electro-deposition coated members of Examples 4-1 to 4-4 and Comparative Example 4-1 are shown in Table 4-1.

TABLE 4-1

| | Adhesion | | Corrosion resistance | | | | |
|---|---|---|---|---|---|---|---|
| | Before boiling | After boiling | 200 hrs | 350 hrs | 500 hrs | 650 hrs | EMS* |
| Example: | | | | | | | |
| 4-1 | 100/100 | 97/100 | 0 | 0 | 0 | 0.5 to 1 | B |
| 4-2 | 100/100 | 97/100 | 0 | 0 | 0 | 0 | A |
| 4-3 | 100/100 | 95/100 | 0 | 0 | 0 | 0 | B |
| 4-4 | 100/100 | 96/100 | 0 | 0 | 0 | 0.5 | A |
| Comparative Example: 4-1 | 75/100 | 35/100 | 0 | 0 | 0 | 1 | C⁻*3 |

*Electromagnetic wave shielding performance
*3C⁻: Shielding performance, Attenuation: 50 to 60 dB

EXAMPLE 5-1

In 100 parts by weight of an acrylic melamine resin (trade name: Honey Bright C-IL; produced by Honey Chemical Co.), 20 parts by weight of a nylon powder with an average particle diameter of 1 μm whose particle surface were coated with nickel by electroless plating in a thickness of 0.2 μm was dispersed for 30 hours using a ball mill, and then the dispersion was diluted with desalted water to 15% by weight as a concentration of solid contents, followed by addition of 2.0% by weight of carbon black for the purpose of coloring to make up a coating composition. An ABS resin plate used as a test piece was treated with an etchant of a $CrO_3$—$H_2SO_4$—$H_2O$ system for 1 minute, and subsequently treated at room temperature for 2 minutes using as a sensitizer solution a solution comprised of 30 g/lit. of stannous chloride and 20 ml/lit. of hydrochloric acid. Subsequently, the substrate thus treated was immersed for 2 minutes in an activator solution comprised of 0.3 g/lit. of palladium chloride and 3 ml/l lit. of hydrochloric acid to deposit palladium on the ABS resin plate, thereby mnaking its surface conductive. Thereafter, electroless plating was carried out to form on the ABS resin plate a copper thin film of 0.2 μm thickness. Subsequently, using an aqueous solution of 5% of sodium hydroxide and 1% of potassium persulfate, the surface of the copper thin film was treated at 70° C. for a half minute to form a cupric oxide film, the chemically colored film.

Using the above coating composition, electro-deposition was carried out of this test piece at an applied voltage of 150 V for 3 minutes under conditions of a bath temperature of 25° C. and pH 8 to 9, setting to the article be coated as the anode and a 0.5 t stainless steel sheet as the opposite electrode. After the electro-deposition, the coated article was washed with water and then heated in an oven of 130° C.±1° C. for 120 minutes to effect curing. An electro-deposition coated member with a coating film of 25 μm thick was thus obtained. In this electro-deposition coating film, the nylon particles coated with nickel were deposited in quantity of 20% by weight. The nickel coatings on the surfaces of the nylon particles were so formed as to have a phosphorus content of not more than 5% by weight.

This electro-deposition coated member was evaluated in the same manner as in Example 1-1.

COMPARATIVE EXAMPLE 5-1

The nylon particle coated with nickel as used in Example 5-1 was mixed with an acrylic coating composition (Kansai Paint No. 2026, an acrylic resin binder) by the air of a toulene solvent, followed by stirring for 10 minutes using a mixer to prepare a conductive coating composition for spraying. The content of the nylon particles coated with nickel was controlled to be in an amount of 40 parts by weight based on 100 parts by weight of the acrylic resin binder. The coating composition thus prepared was spray-coated on the same test piece as used in Example 5-1 followed by drying to produce (1) a member with a coating film formed in a thickness of 10 μm, (2) a member with a coating film formed in a thickness of 25 μm and (3) a member with a coating film formed in a thickness of 100 μm. These were evaluated in the same manner as in Example1-1.

As a result, as shown in Table 5-1, the members (1) and (2) showed poor shielding performance, and the member (3), though showing a relatively good shielding performance, had poor smoothness due to a thick coating film in its appearance that it was not usable as a decorative coating film.

COMPARATIVE EXAMPLE 5-2

An electro-deposition coated member was produced in the same manner as in Example 5-1 except that no copper oxide coating was formed in the ABS resin substrate used in EXample 5-1, and was evaluated in the same manner.

EXAMPLE 5-2

An electro-deposition coated member was produced in the same manner as in Example 5-1 except that the content of the nickel-coated nylon particles in the electro-deposition coating was charged to 50 parts by weight.

EXAMPLE 5-3

An electro-deposition coated member was produced in the same manner as in Example 5-1 except for using a nylon powder with an average particle diameter of 5

μm whose particle surfaces were coated with nickel in a coating thickness of 2 μm.

EXAMPLE5-4

An electro-deposition coated member was produced in the same manner as in Example 5-1 except for using a resin powder comprised of a polyester resin with an average particle diameter of 0.5 μm whose particle surfaces were coated with copper by electroless plating in a thickness of 0.5 μm.

EXAMPLE 5-5

An electro-deposition coated member was produced in the same manner as in Example 5-1 except for using a resin powder comprised of a fluorine resin powder with an average particle diameter of 1 μm whose particle surfaces were coated with copper by electroless plating in a thickness of 0.2 μm.

EXAMPLE 5-6

An electro-deposition coated member was produced in the same manner as in Example 5-1 except that the content of the nickel-coated nylon particles in the electro-deposition coating film was changed to 60 parts by weight.

COMPARTIVE EXAMPLE 5-3

An elecro-deposition coated member was produced in the same manner as in Example 5-5 except for using a fluorine resin powder with an average particle diameter of 8 μm.

The nickel coatings formed on the surfaces of the resin powder particles used in the above Examples 5-1, 5-2, 5-4 and 5-6 and Comparative Examples 5-1 to 5-3 were controlled to have a phosphorus content of not more than 5% by weight.

The electro-deposition coated members obtained in the above Examples 5-1 to 5-6 and Comparative Examples 5-1 to 5-3 were evaluated in the same manner as in Example 1-1. Results obtained are shown in Table 5-1.

TABLE 5-1

| | Adhesion | | Corrosion resistance | | | | |
|---|---|---|---|---|---|---|---|
| | Before boiling | After boiling | 200 hrs | 350 hrs | 500 hrs | 650 hrs | EMS* |
| Example: | | | | | | | |
| 5-1 | 100/100 | 98/100 | 0 | 0 | 0 | 0 | B |
| 5-2 | 98/100 | 80/100 | 0 | 0 | 0 | 0 | A |
| 5-3 | 99/100 | 97/100 | 0 | 0 | 0 | 0 | C |
| 5-4 | 100/100 | 100/100 | 0.5 | 0.5 | 0.5 | 0.5 | A |
| 5-5 | 100/100 | 100/100 | 0.5 | 0.5 | 0.5 | 1 | B |
| 5-6 | 80/100 | 65/100 | 0 | 0 | 0 | 0 | A |
| Comparative Example: 5-1 | | | | | | | |
| (1) | 100/100 | | 0 | 0 | 0 | 0 | D |
| (2) | 100/100 | | 0 | 0 | 0 | 0 | D |
| (3) | 100/100 | | 0 | 0 | 0 | 0.5 | B |
| 5-2 | 90/100 | 30/100 | 3 | Whole area blister | — | — | B |

*Electromagnetic wave shielding performance

EXAMPLE 6-1

In 100 parts by weight of an acrylic melamine resin (trade name: Honey Bright C-IL; produced by Honey Chemical Co.) containing a curing agent, 20 parts by weight, in total, of a nylon powder with an average particle diameter of 1 μm whose particle surfaces were coated with nickel by electroless plating in a thickness of 0.2 μm and a nickel powder with an average particle diameter of 0.03 μm were dispersed for 30 hours using a ball mill, and then the dispersion was diluted with desalted water to 15% by weight as a concentration of solid contents, followed by addition of 2.0% by weight of carbon black for the purpose of coloring to make up a coating composition. An ABS resin plate used as a test piece was treated with an etchant of a $CrO_3$—$H_2SO_4$—$H_2O$ system for 1 minute, and subsequently treated at room temperature for 2 minutes using as a sensitizer solution a solution comprised of 30 g/lit. of stannous chloride and 20 ml/lit. of hydrochloric acid, followed by catalytic treatment using palladium. Thereafter, electroless plating was carried out to form on the ABS resin plate a nickel thin film of 0.5 μm thickness, followed by treatment with 63% concentrated nitric acid for 30 minutes to form a nickel oxide film, the chemically colored film.

Using the above coating composition, electro-deposition was carried out on this test piece for 3 minutes at applied voltages raised by 50 V within the range of from 50 V to 150 V, under conditions of a bath temperature of 25° C. and pH 8 to 9, setting the article to be coated as the anode and a 0.5 t stainless steel sheet as the opposing electrode. After the electro-deposition, the coated article was washed with water and then heated in an oven of 150° C.±1° C. for 60 minutes to effect curing. An electro-deposition coated member with a coating film of 25 μm thickness was thus obtained. In this electro-deposition coating film, the nylon particles coated with nickel and the metal powder particles were deposited in a quantity of 20% by weight.

Physical properties (adhesion and corrosion resistance) and electromagnetic wave shielding effect of the coating film of the electro-deposition coated member thus obtained were evaluated in the same manner as in Example 1-1.

EXAMPLE 6-2

Electro-deposition was carried out in the same manner as in Example 6-1 except for using an electro-deposition coating composition obtained by dispersing 55 parts by weight of a mixture of nickel-coated nylon particles and nickel powder in 100 parts by weight of the acrylic melamine resin and diluting the dispersion to 15% by weight as a concentration of solid contents. An electro-deposition coated member was thus produced, in which the electro-deposition coating film had a conductive particles deposition quantity of 50% by weight.

EXAMPLE 6-3

Electro-deposition was carried out in the same manner as in Example 6-1 except for using an electro-deposition coating composition obtained by dispersing 150 parts by weight of a mixture of nickel-coated nylon particles and nickel powder in 100 parts by weight of the acrylic melamine resin and diluting the dispersion to 10% by weight as a concentration of solid contents. An electro-deposition coated member was thus produced, in which the electro-deposition coating film had a conductive particles deposition quantity of 60% by weight.

EXAMPLE 6-4

An electro-deposition coated member was produced in the same manner as in Example 6-1 except for using a nylon powder with an average particle diameter of 5 μm whose particle surfaces were coated with nickel in a thickness of 1.5 μm and a nickel powder with an average particle diameter of 5 μm.

EXAMPLE 6-5

An electro-deposition coated member was produced in the same manner as in Example 6-1 except for using a resin powder comprised of a polyester resin with an average particle diameter of 0.5 μm whose particle surfaces were coated with nickel by electroless plating in a thickness of 0.5 μm and also a metal powder comprised of a copper powder with an average particle diameter of 0.02 μm.

EXAMPLE 6-6

An electro-deposition coated member was produced in the same manner as in Example 6-1 except for using a resin powder comprised of a fluorine resin powder with an average particle diameter of 1 μm whose particle surfaces were coated with copper by electroless plating in a thickness of 0.2 μm and also a metal powder comprised of a nickel powder with an average particle diameter of 0.1 μm.

COMPARATIVE EXAMPLE 6-1

An electro-deposition coated member was produced in the same manner as in Example 6-6 except for using a fluorine resin powder with an average particle diameter of 8 μm whose particle surfaces were coated with copper by electroless plating in a thickness of 0.2 μm and also a nickel powder with an average particle diameter of 10 μm.

In respect of the above electro-deposition coated members of Examples 6-1 to 6-6 and Comparative Example 6-1, the adhesion, corrosion resistance and electromagnetic wave shielding effect of the electro-deposition coating films were evaluated in the same manner as in Example 1. Results obtained are shown in Table 6-1.

TABLE 6-1

| | Adhesion | | Corrosion resistance | | | | |
|---|---|---|---|---|---|---|---|
| | Before boiling | After boiling | 200 hrs | 350 hrs | 500 hrs | 650 hrs | EMS* |
| Example: | | | | | | | |
| 6-1 | 95/100 | 94/100 | 0 | 0 | 0 | 0 | A |
| 6-2 | 96/100 | 90/100 | 0 | 0 | 0.5 | 1 | A |
| 6-3 | 80/100 | 81/100 | 0 | 0 | 0 | 0 | A |
| 6-4 | 95/100 | 90/100 | 0 | 0 | 0 | 0 | B |
| 6-5 | 96/100 | 92/100 | 0 | 0 | 0 | 0.5 | A |
| 6-6 | 95/100 | 91/100 | 0 | 0 | 0 | 0 | A |
| Comparative Example: 6-1 | 80/100 | 55/100 | 0.5 | 0.5 | 1 | 1 | C |

*Electromagnetic wave shielding performance

I claim:

1. An electro-deposition coated member comprising a metal substrate or a non-metal substrate having been subjected to metal plating, a chemically colored film provided on said substrate, and a conductive electro-deposition coating film formed on said chemically colored film.

2. An electro-deposition coated member according to claim 1, wherein said metal substrate comprises a copper substrate and said chemically colored film comprises a film comprising an oxide of copper.

3. An electro-deposition coated member according to claim 1, wherein said metal plating is copper plating and said chemically colored film comprises a copper oxide film formed by oxidation of the surface of the copper-plated substrate.

4. An electro-deposition coated member according to claim 3, wherein said copper plating is applied in a coating thickness of 0.05 μm to 0.2 μm.

5. An electro-deposition coated member according to claim 1, wherein said electro-deposition coating film containing conductive particles in a deposition quantity of from 5% by weight to 50% by weight.

6. An electro-deposition coated member according to claim 5, wherein said conductive particles comprises a ceramic powder whose particle surfaces are coated with a metal.

7. An electro-deposition coated member according to claim 5, wherein said conductive particles comprises at least one of i) a resin powder having an average particle diameter of from 0.1 to 5 μm whose particle surfaces are coated with a metal and ii) an ultrafine metal powder having an average particle diameter of from 0.01 to 5 μm.

8. An electro-deposition coated member according to claim 5, wherein said conductive particles comprises a mixture of at least one of i) a resin powder having an average particle diameter of from 0.1 to 5 μm whose particle surfaces are coated with a metal and ii) an ultrafine metal powder having an average particle diameter of from 0.01 to 5 μm, and a ceramic powder whose particle surfaces are coated with a metal.

9. An electro-deposition coated member according to claim 6, wherein said ceramic powder has an average particle diameter of from 0.1 μm to 5 μm.

10. An electro-deposition coated member according to claim 8, wherein the proportion of said ceramic powder whose particle surfaces are coated with a metal to the other conductive particles is 1:0.2 to 3.

11. An electro-deposition coated member according to claim 5, wherein said conductive particles comprise a natural mica powder whose particle surfaces are coated with a metal.

12. An electrode-deposition coated member according to claim 5, wherein said conductive particles comprise a mixture of a ceramic powder whose particle surfaces are coated with a metal and a natural mica powder whose particle surfaces are coated with a metal.

13. An electro-deposition coated member according to claim 5, wherein said conductive particles comprise a mixture of a ceramic powder whose particle surfaces are coated with a metal and a natural mica powder whose particle surfaces are coated with a metal, and at least one of i) a resin powder having an average particle diameter of from 0.1 to 5 μm, whose particle surfaces are coated with a metal and ii) an ultrafine metal powder having an average particle diameter of from 0.01 to 5 μm.

14. An electro-deposition coated member according to claim 11, wherein said natural mica powder has an averagee particle diameter of from 0.1 μm to 5 μm.

15. An electro-deposition coated member according to claim 13, wherein the proportion of said mixture of the metallized ceramic powder and the metallized natural mica powder to other conductive particles is 1:0.2 to 3.

16. An electro-deposition coated member comprising a metal substrate or a non-metal substrate having been subjected to metal plating, and an electro-deposition coating film provided thereon, said electro-deposition coating film containing at least one of i) a resin power having an average particle diameter of from 0.1 to 5 μm whose particle surfaces are coated with a metal and ii) an ultrafine metal powder having an average particle diameter of from 0.01 to 5 μm.

17. An electro-deposition coated member according to claim 16, wherein said electro-deposition coating film contains at least one of the metallized resin powder and metallized ultrafine metal powder in a deposition quantity of from 5% by weight to 50% by weight.

18. An electro-deposition coating composition comprising a resin feasible for electro-deposition, and at least one of i) a resin powder having an average particle diameter of from 0.1 to 5 μm whose particle surfaces are coated with a metal an ii) an ultrafine metal powder having an average particle diameter of from 0.01 to 5 μm.

19. An electro-deposition coating composition comprising a resin feasible for electro-deposition, a ceramic powder having an average particle diameter of from 0.1 to 5 μm whose particle surfaces are coated with a metal, and at least one of i) an ultrafine metal powder having an average particle diameter of from 0.01 to 5 μm and ii) a resin powder having an average particle diameter of from 0.01 to 5 μm whose particle surfaces are coated with a metal.

20. An electro-deposition coating composition comprising a resin feasible for electro-deposition, a natural mica powder whose particle surfaces are coated with a metal, and at least one of i) a ceramic powder whose particle surfaces are coated with a metal, ii) a resin powder having an average particle diameter of from 0.1 to 5 μm whose particle surfaces are coated with a metal and ii) an ultrafine metal powder having an average particle diameter of from 0.01 to 5 μm.

21. An electro-deposition coating composition comprising as conductive particles a natural mica powder whose particle surfaces are coated with a metal.

22. Electronic machinery comprising a housing and an electronic part enclosed in said housing, the latter being a source from which an electromagnetic wave noise is generated, wherein said housing comprises a metal substrate or a non-metal substrate having been subjected to metal plating, a chemically colored film provided on said substrate, and a conductive electro-deposition coating film formed on said chemically colored film.

* * * * *

UNITED STATES PATENT AND TRADEMARK OFFICE

CERTIFICATE OF CORRECTION

PATENT NO. : 5,145,733

DATED : September 8, 1992

INVENTOR(S) : SUSUMU KADOKURA

It is certified that error appears in the above-identified patent and that said Letters Patent is hereby corrected as shown below:

COLUMN 2

Line 25, "effect" should read --affects--.

COLUMN 3

Line 5, "of;" should read --of:--.

COLUMN 4

Line 10, "electroo-deposition" should read --electro-deposition--.

COLUMN 5

Line 56, "particles" should read --particle--.
Line 67, "enables" should read --enable--.

COLUMN 6

Line 17, "cles" should read --cle--.
Line 27, "coating" should read --coatings--.
Line 29, "particles ," should read --particles,--.
Line 41, "coating" should read --coatings--.

COLUMN 10

Line 21, "particles" should read --particle--.

COLUMN 13

Line 50, "0.5" should read --0.5t--.
Line 51, "t" should be deleted.

--

UNITED STATES PATENT AND TRADEMARK OFFICE

CERTIFICATE OF CORRECTION

PATENT NO. : 5,145,733

DATED : September 8, 1992

INVENTOR(S) : SUSUMU KADOKURA

It is certified that error appears in the above-identified patent and that said Letters Patent is hereby corrected as shown below:

COLUMN 14

Line 33, "0.5" should read --0.5t--.
Line 34, "t" should be deleted.

COLUMN 16

Line 9, "particles" should read --particle--.

COLUMN 18

Line 59, "particles" should read --particle--.

COLUMN 21

Line 5, "0.5" should read --0.5t--.
Line 6, "t" should be deleted.
Line 63, "0.5 t" should read --0.5t--.

COLUMN 23

Line 39, "0.5 t" should read --0.5t--.

COLUMN 24

Line 19, "0.5 t" should read --0.5t--.
Line 67, "0.5 t" should read --0.5t--.

COLUMN 26

Line 11, "0.5 t" should read --0.5t--.
Line 12, "opposite" should read --opposing--.
Line 30, "air" should read --aid--.

UNITED STATES PATENT AND TRADEMARK OFFICE

CERTIFICATE OF CORRECTION

PATENT NO. : 5,145,733

DATED : September 8, 1992

INVENTOR(S) : SUSUMU KADOKURA

It is certified that error appears in the above-identified patent and that said Letters Patent is hereby corrected as shown below:

COLUMN 28

Line 25, "0.5 t" should read --0.5t--.
Line 50, "particles" should read --particle--.
Line 62, "particles" should read --particle--.

COLUMN 30

Line 8, "containing" should read --contains--.
Line 22, "comprises" should read --comprise--.
Line 40, "electrode-deposition" should read --electro-deposition--.
Line 67, "resin power" should read --resin powder--.

COLUMN 31

Line 14, "an" (first occurrence) should read --and--.

Signed and Sealed this

Eighteenth Day of January, 1994

Attest:

Bruce Lehman

BRUCE LEHMAN

Attesting Officer

Commissioner of Patents and Trademarks